US010920423B2

(12) United States Patent
Niederlaender

(10) Patent No.: US 10,920,423 B2
(45) Date of Patent: Feb. 16, 2021

(54) METHOD FOR PRODUCING A BAR ELEMENT

(71) Applicants: Joern Niederlaender, Nettetal (DE); Robert Klanten, Viersen (DE)

(72) Inventor: Joern Niederlaender, Nettetal (DE)

(73) Assignees: Joern Niederlaender, Nettetal (DE); Robert Klanten, Viersen (DE)

( * ) Notice: Subject to any disclaimer, the term of this patent is extended or adjusted under 35 U.S.C. 154(b) by 271 days.

(21) Appl. No.: 15/752,293

(22) PCT Filed: Aug. 12, 2016

(86) PCT No.: PCT/DE2016/100360

§ 371 (c)(1),
(2) Date: Feb. 13, 2018

(87) PCT Pub. No.: WO2017/028841

PCT Pub. Date: Feb. 23, 2017

(65) Prior Publication Data

US 2018/0238054 A1 Aug. 23, 2018

(30) Foreign Application Priority Data

Aug. 14, 2015 (DE) ..... 20 2015 104 295 U

(51) Int. Cl.
*B05D 1/28* (2006.01)
*B05D 7/06* (2006.01)
(Continued)

(52) U.S. Cl.
CPC ..... *E04C 3/29* (2013.01); *B05D 1/28* (2013.01); *B05D 1/40* (2013.01); *B05D 3/12* (2013.01);
(Continued)

(58) Field of Classification Search
CPC . E04C 3/29; E04C 3/127; E04C 3/185; B63B 3/06; B63B 15/00; B27K 9/002;
(Continued)

(56) References Cited

U.S. PATENT DOCUMENTS 788,189 A 4/1905 Conrow
1,372,819 A 3/1921 Johansson
(Continued)

FOREIGN PATENT DOCUMENTS

CN 111 79 10 A 3/1996
CN 16 500 74 A 8/2005
(Continued)

OTHER PUBLICATIONS

Staves and Segments. https://web.archive.org/web/20151207061020/https://www.woodmagazine.com/woodworking-tips/techniques/intermediate/staves-and-segments (accessed Jul. 2, 2020). (Year: 2015).*

(Continued)

*Primary Examiner* — William P Fletcher, III
(74) *Attorney, Agent, or Firm* — Collard & Roe, P.C.

(57) ABSTRACT

A bar element as a construction element includes strips preferably produced from bamboo and is hollow at least in certain regions. The hollow interior is formed at least in certain sections as a hollow fillet achieved by a plastic and/or resin introduced into the bar elements, using a shaped body movable through the interior. Producing bar elements from interconnected strips ensures that although produced from a natural raw material, the bar elements have a reproducible outer cross section. Using a shaped body movable through the interior to produce the inner cross section also ensures a defined inner cross section of the bar elements, with the result that in turn connections between a plurality of bar elements that are defined by suitable connection elements
(Continued)

can be formed. In this way, the bar elements make it possible to produce lattice works, grid constructions, frameworks or other desired structures and/or three-dimensional bodies.

18 Claims, 7 Drawing Sheets

(51) Int. Cl.

| | |
|---|---|
| ***B05D 3/12*** | (2006.01) |
| ***B05D 7/22*** | (2006.01) |
| ***B05D 1/40*** | (2006.01) |
| ***E04C 3/29*** | (2006.01) |
| ***B27M 3/00*** | (2006.01) |
| ***E04C 3/12*** | (2006.01) |
| ***E04C 3/18*** | (2006.01) |
| ***B63B 3/06*** | (2006.01) |
| *B63B 15/00* | (2006.01) |

(52) U.S. Cl.
CPC ..... *B05D 7/06* (2013.01); *B05D 7/22* (2013.01); *B27M 3/0053* (2013.01); *B63B 3/06* (2013.01); *E04C 3/127* (2013.01); *E04C 3/185* (2013.01); *B05D 2203/20* (2013.01); *B05D 2254/04* (2013.01); *B63B 15/00* (2013.01)

(58) Field of Classification Search
CPC ..... B27K 3/0053; B05D 1/40; B05D 3/12; B05D 7/22; B05D 7/222; B05D 7/225; B05D 7/06; B05D 2203/20
See application file for complete search history.

(56) References Cited

U.S. PATENT DOCUMENTS

| | | | | | |
|---|---|---|---|---|---|
| 1,932,986 | A * | 10/1933 | Powell | A01K 87/00 | 43/18.1 R |
| 3,211,573 | A * | 10/1965 | Hight | B05C 7/08 | 138/97 |
| 3,329,147 | A | 7/1967 | Barron | | |
| 4,468,273 | A * | 8/1984 | Eklund | E04C 3/36 | 156/286 |
| 4,640,437 | A | 2/1987 | Weingartner | | |
| 5,438,812 | A * | 8/1995 | Erickson | B27M 3/006 | 52/233 |
| 5,876,649 | A * | 3/1999 | Ryan | B29C 70/48 | 264/136 |
| 2003/0207098 | A1* | 11/2003 | Ryan | B29C 70/48 | 428/297.4 |
| 2006/0053729 | A1* | 3/2006 | Wallner | E04B 1/585 | 52/655.1 |
| 2007/0101674 | A1 | 5/2007 | Stinson | | |
| 2009/0188149 | A1* | 7/2009 | Smith | A01K 87/00 | 43/18.1 R |
| 2010/0083605 | A1* | 4/2010 | Wallner | B27J 1/00 | 52/655.1 |
| 2013/0316127 | A1 | 11/2013 | Yako | | |

FOREIGN PATENT DOCUMENTS

| | | | | |
|---|---|---|---|---|
| CN | 101 596 733 | A | 12/2009 | |
| CN | 104 231 603 | A | 12/2014 | |
| DE | 19502380 | A1 * | 12/1995 | |
| DE | 10 2007 015 018 | A | 9/2008 | |
| DE | 10 2007 015 018 | A1 | 9/2008 | |
| DE | 20 2014 101 157 | U1 | 3/2014 | |
| DE | 20 2015 104 295 | U1 | 10/2015 | |
| EP | 2422641 | A1 * | 2/2012 | A45B 25/02 |
| FI | 121523 | B * | 12/2010 | |
| FR | 348 209 | A | 4/1905 | |
| FR | 2 512 729 | A1 | 3/1983 | |
| GB | 126 045 | A | 5/1919 | |
| GB | 564 845 | A | 10/1944 | |
| NL | 6708009 | A * | 12/1968 | B29C 55/28 |
| NL | 8 402 779 | A | 4/1986 | |
| NL | 8402779 | A * | 4/1986 | E04C 3/127 |
| WO | 98/19030 | A1 | 5/1998 | |
| WO | 03/064783 | A1 | 8/2003 | |
| WO | 2013/157771 | A1 | 10/2013 | |

OTHER PUBLICATIONS

"Fillet, n.1." OED Online. Oxford University Press, Jun. 2020. Web. Jul. 2, 2020. (Year: 2020).*
International Search Report of PCT/DE2016/100360, dated Nov. 30, 2016.
Cherif et al., "High-performance wooden support structures—HHT—Development of composite designs in wooden construction, able to withstand great stress, with fiber-reinforced plastics, technical textiles, and shaped pressed wood," HESS Timer Limitless, Technische Universitat Dresden, Feb. 2011, p. 35 (2 pages).
Van Nostrand's Scientific Encyclopedia, Fillet, Fourth Edition 1968, 3 pages.

* cited by examiner

METHOD FOR PRODUCING A BAR ELEMENT

CROSS REFERENCE TO RELATED APPLICATIONS

This application is the National Stage of PCT/DE2016/100360 filed on Aug. 12, 2016, which claims priority under 35 U.S.C. § 119 of German Application No. 20 2015 104 295.7 filed on Aug. 14, 2015, the disclosure of which is incorporated by reference. The international application under PCT article 21(2) was not published in English.

BACKGROUND OF THE INVENTION

1. Field of the Invention

The invention relates to a bar element as a construction element, wherein the bar element consists of a plurality of strips, preferably produced from bamboo, and is configured as a hollow element at least in certain sections, wherein the interior of the hollow element is configured as a fillet, at least in certain sections.

2. Description of the Related Art

Such a bar element is already previously known from DE 20 2014 101 157 U1.

Furthermore, it is previously known from WO 2013/157 771 A1 to produce a bicycle frame from bamboo, in which straight or bent bamboo bars can be joined together by means of suitable connection elements to produce a bicycle frame. Furthermore, it is previously known from a final report regarding a BMBF [German Federal Ministry of Education and Research] research project of the Technical University of Dresden, "High-performance wooden support structures—HHT—Development of composite designs in wooden construction, able to withstand great stress, with fiber-reinforced plastics, technical textiles, and shaped pressed wood" to produce shaped wooden profiles and to process them in such a manner, by means of targeted introduction of compressed and non-compressed types of wood, that in this way, profiles having changeable radii of curvature can be produced. It is described as an alternative production method that strip cross-sections can be connected with one another by means of joining processes, even without any shaping process. In this regard, it is considered disadvantageous that more or less complicated dressing procedures performed on the strip segment are necessary for every cross-section in order to achieve the desired geometries. A further problem in this connection is what is called the "memory effect," in other words that shaped wooden profiles shaped in this way tend to resume their original shape again after some time.

SUMMARY OF THE INVENTION

Proceeding from this state of the art, the invention is based on the task of indicating a method for the production of bar elements with which such bar elements can be produced, which elements are subsequently suitable for use as a construction element, also for the production of support structures, lattice works, grid constructions or other three-dimensional bodies and geometric bodies.

The task on which the invention is based is accomplished by means of a bar element according to the invention.

Advantageous embodiments of the invention can be derived from the discussion below.

In detail, the task on which the invention is based is accomplished in that the fillet formation of the bar element is implemented by means of a plastic and/or resin that is introduced into the bar elements, using a shaped body that can be moved through the interior of the bar element. The advantage as compared with solutions previously known from the state of the art consists in that the corresponding bar elements are produced from a natural and rapidly renewable raw material, namely bamboo, wherein the production of this bar element takes place by means of joining together strips having a defined cross-section, to form a bar that possesses a defined interior cross-section, since the inner configuration of the bar element as a fillet is implemented in that a movable shaped body is moved through the interior of the bar element, wherein previously, the interior of the bar element was provided with an introduced plastic and/or resin, which is brought into a defined shape, namely the shape of a fillet, by means of the shaped body, and subsequently hardens in this shape, which is in accordance with its intended purpose. Alternatively, the fillets formed in the interior of the bar element can also be implemented by means of an inner tube that is pushed into the interior of the bar element, and coated with an outer plastic and/or resin mantle, preferably a fiber-reinforced mantle, on the outside. After completion of the hardening process of the materials that form the outer mantle, the inner tube can be pulled out of the bar element, against the background of its previous coating with a parting agent, leaving the outer mantle that forms the fillet.

The configuration of the interior of the bar element as described above brings about a reinforcement of the bar elements produced in this manner, which accordingly possess greater stability and, in particular, possess the required pressure resistance and tensile strength as construction elements. A further significant advantage of the solution according to the invention consists in that in contrast to naturally grown bamboo, a uniform tube cross-section is achieved over just about any tube length, as is a precise wall thickness, by means of the production of the bar elements according to the invention. Because the individual bar elements can be produced with a defined cross-section and a defined wall thickness, the bar elements produced accordingly can be manufactured, used, and processed further industrially. This is not possible in connection with naturally grown bamboo tubes, since their diameter and wall thickness changes over the length of the bamboo tubes, and furthermore, the individual bamboo tubes also possess different diameters, cross-sections, and wall thicknesses, in each instance, and this accordingly makes connecting the natural bamboo tubes with one another more difficult or impossible, even with different connection elements and materials. The bar elements produced from the aforementioned bamboo strips can be recycled, and, depending on the adhesive connection used, can actually be completely recyclable or ecologically biodegradable.

In a concrete embodiment, the shaped body that can be moved through the interior of the bar element is a movable piston.

In the event of formation of the fillet using the inner tube according to the invention, the outer mantle introduced in connection with the inner tube, which mantle remains in the bar element after the inner tube is pulled out, can be provided with a fiber structure that is optimally coordinated with the expected stress on the bar elements. Thus, depending on the application, glass fibers, or carbon fibers can be worked into the outer mantle in the longitudinal or transverse direction, with the formation of a woven lattice structure, in the simplest manner, in that either the woven structure is wrapped around the inner tube or that the longitudinal or transverse fibers are already worked into the outer mantle.

The strips used for formation of the bar elements possess a trapezoid cross-section, so that the individual strips can be permanently connected with one another in the region of the longitudinal edges of the strip, which are set at a slant, in accordance with their intended use, to form a round bar element.

In a concrete embodiment, six or eight of the strips indicated above are connected to form a closed bar element, by means of an adhesive connection, which element subsequently has a hexagonal or octagonal cross-section. In this connection, the strips are connected with one another along their longitudinal edges, in such a manner that they complement one another to form the closed bar element described above.

In a further improved embodiment, the longitudinal edges of the strips are configured to be planar to form the bar elements, so that in this way, good adhesion behavior of the adjacent strips in the region of these longitudinal edges for formation of an adhesive connection is guaranteed.

The embodiment of the inner contour of the bar elements, by means of the movable shaped body, can also be impressible in certain sections, if necessary, in order to impress a defined inner contour in the face-side end region of the bar elements, in particular, for example a triangular or square or round inner contour, which in turn can be helpful if multiple bar elements are supposed to be connected with one another in the longitudinal direction, following one another, for example by means of the use of internally hollow bodies that can be pushed into this inner contour with a corresponding outer contour.

In a concrete embodiment, an internally hollow body can be pushed into the defined inner contour, in particular into the face-side inner contour of a bar element, in such a manner that this internally hollow body possesses an excess length as compared with the one bar element, and a subsequent other bar element can be set onto this excess length analogously, so that two bar elements are connected with one another using the internally hollow body.

In a further embodiment, two bar elements, in each instance, can also be connected with one another by means of an angled-away or cropped internally hollow body, wherein the angled-away or cropped passage of the internally hollow body is disposed in the intermediate region between the two bar elements, and thereby a corner connection or curve connection between the two bar elements involved in this connection is also produced.

In an even more improved embodiment, multiple bar elements can also be joined together by means of one or more internally hollow bodies, which in turn are provided with multiple connector pieces, if necessary, in other words branch off relative to these connector pieces, to produce polygonal constructions, grid constructions, three-dimensional bodies, geometric bodies or lattice works.

In a modified and even further improved embodiment, the bar elements can also be connected with one another by means of suitable internally hollow bodies, wherein the internally hollow bodies used for a connection in this regard are provided with at least one articulated connection, in each instance, in the connection region that lies between the bar elements to be connected. In this embodiment, articulated connections can be produced within the scope of the invention, in other words three-dimensional bodies that can be changed in terms of their outer shape.

Furthermore, it is conceivable that separate connection elements, each comprising at least two cuff sections that are spaced apart from one another, can be set onto the excess lengths of the internally hollow bodies disposed between the bar elements that are to be connected, in such a manner that the face-side end sections of the internally hollow bodies are held with shape fit in these cuff sections, in each instance. The use of the aforementioned cuff sections opens up an expanded field of applications for the constructions produced by means of the bar elements produced according to the invention, because the corresponding cuff sections can be produced from a different material from that of the bar elements or the internally hollow bodies, and accordingly can be optimally adapted to the respective requirements.

This furthermore holds true also for the internally hollow bodies, articulated connections, connection elements and/or cuff sections used in this regard. Thus, these intermediate pieces, between the bar sections according to the invention, which are used as connection elements in the broadest sense, can be produced in cost-advantageous manner, in each instance, but with precise dimensions and in adaptation to the respective individual case, using a 3D printing method.

In this regard, the bar elements according to the invention do not have to be produced as closed bar elements, but rather, within the scope of the invention, half-round or other half-open bar elements can be produced by means of the strips used for production of the bar elements.

By means of the bar elements produced within the scope of the invention, wall-like structures or honeycomb-like wall structures can also be produced in that multiple of the bar elements according to the invention are joined together with one another along their outer contour, to produce composite bar arrangements. This means, in concrete terms, that non only framework constructions or lattice work constructions or grid constructions can be produced with the bar elements according to the invention, but also closed wall structures or room structures can be produced, wherein it is possible, using the aforementioned honeycomb structure, to fulfill the desired strength limits, insulation properties or stability criteria, in each instance, in simple manner, in that a composite bar arrangement having the required wall thickness is produced, in each instance. Thus, using the composite bar arrangements according to the invention, it is also possible to produce buildings or sections of buildings. In this regard, the constructions according to the invention possess the advantage that they are produced in resource-saving manner, from a natural raw material or at least an extensively natural raw material, and furthermore, they possess a lower weight and easier workability as compared with conventional constructions made of stone or other solids.

In an advantageous embodiment, not only the closed bar elements but also open bar elements or closed half-bar elements can be integrated into the aforementioned composite bar arrangements.

In a further advantageous embodiment, the composite bar arrangement can have planks on one or both sides, or be produced as a sandwich construction right from the start, wherein the inner layer is formed by the composite bar arrangement explained above, in each instance. In this case, the composite bar arrangement can be supplemented with the interposition of insulation materials and/or reinforcement materials, if necessary.

BRIEF DESCRIPTION OF THE DRAWINGS

The invention will be explained below, using one or more exemplary embodiments.

The figures show.

DETAILED DESCRIPTION OF THE PREFERRED EMBODIMENTS

Figure 1:
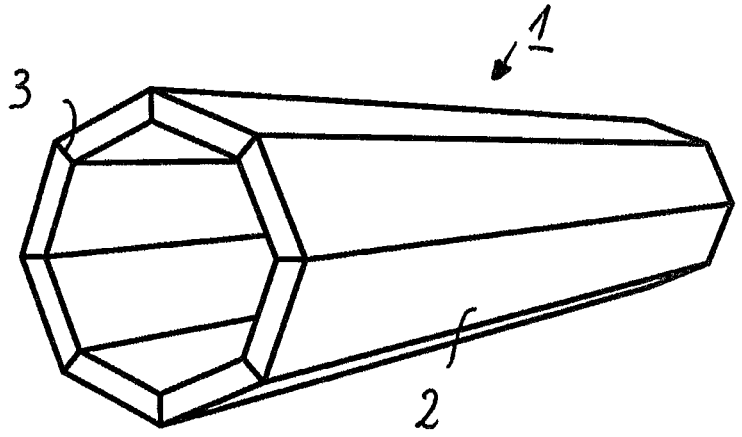
FIG. 1: a bar element having an octagonal outer cross-section, in a perspective view.

FIG. 1, in a perspective view, shows a bar element 1 that consists of a plurality of strips 2 produced from bamboo, wherein the strips 2 each possess a trapezoid cross-section. In this regard, the strips 2 are connected with one another in the region of their longitudinal edges 3, by means of a suitable adhesive connection, in each instance. After the strips 2 are produced using an industrial cutting method, it is ensured that the longitudinal edges 3 are configured in planar manner, to form a strong connection, and furthermore so that the bar elements 1 produced by means of the method according to the invention are provided with reproducible cross-sections, in each instance.

Figure 2:
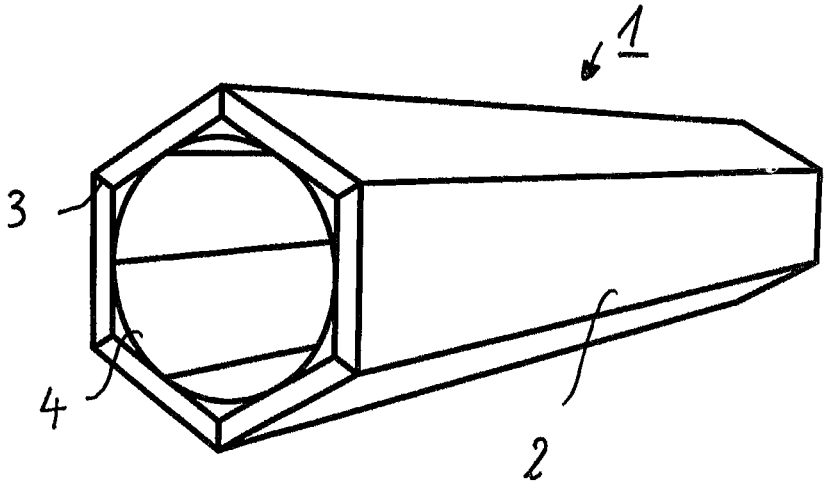
FIG. 2: a bar element having a hexagonal outer cross-section, having a fillet formation, in a perspective view.

In a further work step, the bar elements 1 according to FIG. 2 can be coated with a plastic and/or resin on their inner walls, and in a further work step, a movable piston having a round outer cross-section can be guided through the bar element 1, at least in certain sections, with the result that a round inner cross-section 4 is impressed on the bar element 1, in other words a fillet is formed, which is also strong after the laminate material that was introduced has hardened. Accordingly, the bar elements 1 according to FIG. 2 also possess a reproducible inner cross-section with clearly defined dimensions.

Figure 3:
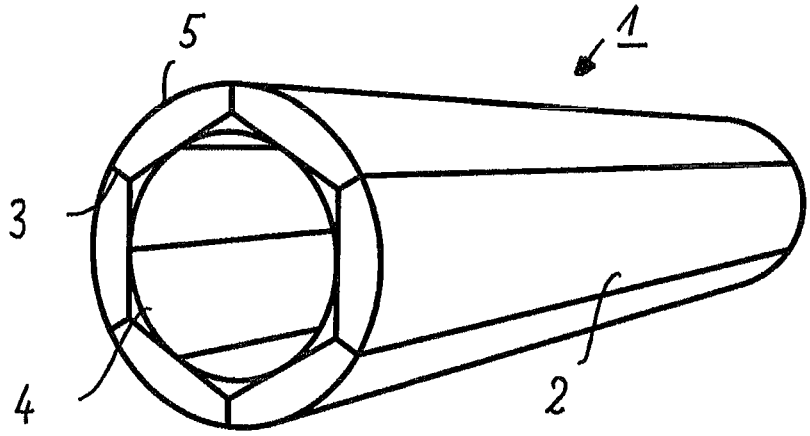
FIG. 3: a further bar element having an integrated, coated inner tube as well as a round outer cross-section, in a perspective view.

According to the representation in FIG. 3, the polygonal bar elements according to the representations in FIGS. 1 and 2 can also be worked in such a manner that bar elements 1 having a round outer cross-section 5 are produced from the polygonal ones. This can be implemented in that the polygonal pipes are lathed on their outside, until the desired round outer cross-section 5 has formed. The problem that exists in this connection, that of a reduced wall thickness due to the outer cross-section of the bar element 1 being lathed away on the outside, can be corrected, according to the representation in FIG. 3, in that a round inner tube 7, which is provided with an outer mantle 8, is introduced into the interior of the bar element 1. The outer mantle 8 is applied to the inner tube 7 from the outside, with the interposition of a parting layer, and usually consists of resin or plastic or of a composite of these materials, wherein in addition, glass fibers, or carbon fibers are worked into this outer mantle for further reinforcement, in a manner that is not shown in any detail. These fibers can be introduced into the outer mantle 8 in simple manner, in the form of a woven mat that is wound around the inner tube 7, but also worked into the outer mantle 8 as individual fibers, in the longitudinal and/or transverse direction. After the outer mantle 8 has hardened, the inner tube 7, due to the parting layer that lies in between, can simply be pulled out of the bar element 1, which then possess a round inner cross-section, and, due to the integrated fiber arrangement, possesses greater rigidity, by means of which the loss in rigidity that was brought about by lathing off the outer cross-section of the bar element is compensated or overcompensated.

Figure 4:
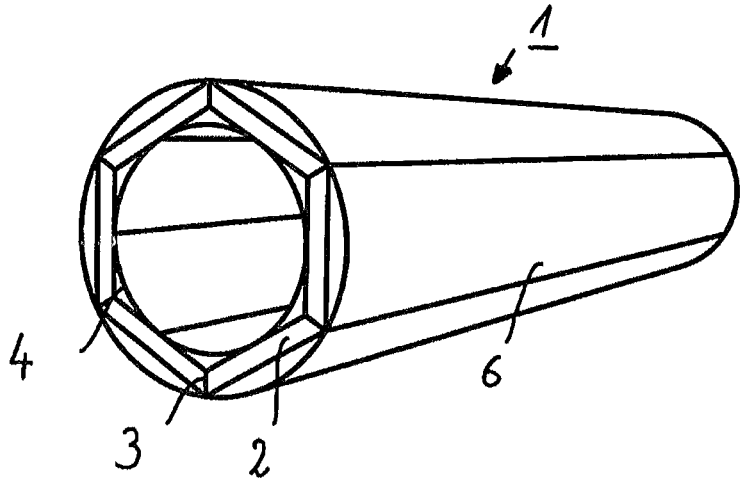
FIG. 4: a bar element having a round outer cross-section, in an alternative embodiment, in a perspective view.

Alternatively, according to the representation in FIG. 4, the outer surface of the outer cross-section of the bar element 1 can be reinforced by means of application of a further bamboo strip 6, in each instance, and the bar element 1 can be lathed off only then, until once again, a round outer cross-section 5 is achieved. This occurs with the difference that the wall thickness of the bar element 1 achieved in this way is clearly reinforced as compared with the embodiment in FIG. 3.

Figure 5:
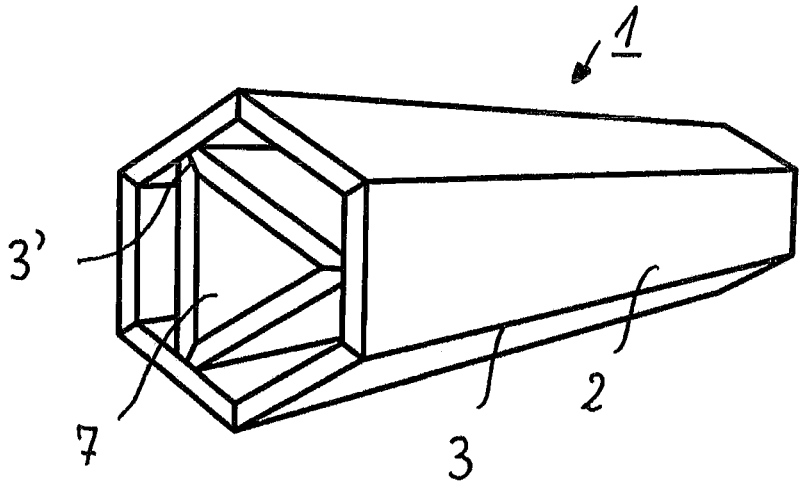
FIG. 5: a bar element having an inner reinforcement, in a perspective view.

The bar elements 1 according to the representations in FIGS. 1-4 can be reinforced and stiffened by means of suitable inner reinforcements, if necessary, wherein according to the representation in FIG. 5, a triangular inner tube 7 was used, which is preferably also produced from bamboo and is produced, analogously, in that the bamboo strips for production of the inner tube 7 are connected with one another in the region of their longitudinal edges 3'—for example by means of a suitable adhesive connection. This inner tube 7 is introduced into the bar element 1 to reinforce it, in the sense of a press fit, and accordingly brings about greater strength of the bar element 1. Alternatively or in addition, the interior of the bar element 1 can also be filled with a filling compound, for example filled with foam, wherein in this connection, either only the interior of the inner tube 7 or the entire interior of the bar element 1 can be filled with compound or filled with foam.

Figure 6:
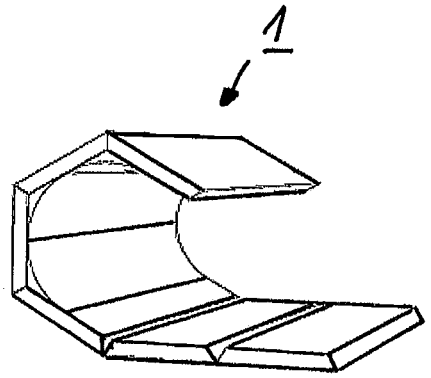
FIG. 6: a bar element in a half-open embodiment, FIG. 7 *a*)-*c*): a connection of two bar elements in different connection stages, each in a perspective view, FIG. 8 *a*)-*d*): a right-angle connection of two bar elements in different connection stages, each in a perspective view, FIG. 9 *a*)-*c*): a cross-connection of two bar elements in different stages, each in a perspective view.

FIG. 6, also in a perspective view, shows a bar element that has not yet been completed.

Figure 7:
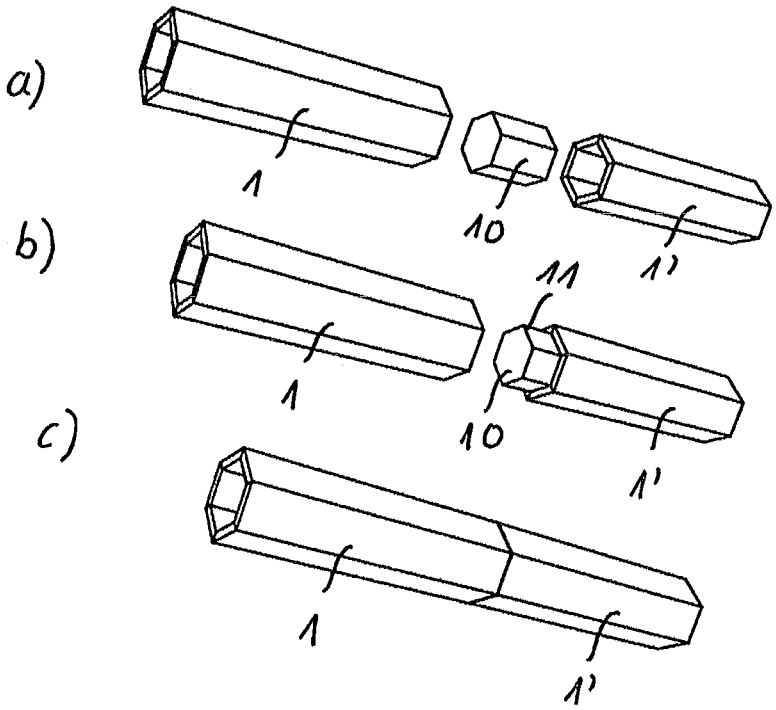

According to the perspective representation in FIG. 7, multiple bar elements 1 can be joined together by means of suitable connection elements. According to the representation in FIG. 7, internally hollow bodies 10, which can but do not have to be bar elements 1, 1' according to the invention, once again, can be pushed into the defined inner cross-section of a bar element 1, with shape fit, specifically in such a manner that the internally hollow body 10 according to the representation in FIG. 7 *b*) forms an excess length 11 as compared with the one bar element 1, before the other bar element 1' is then set onto the internally hollow body 10, and thereby a connection of the two bar elements 1, 1' is produced according to FIG. 7 *c*).

Figure 8:
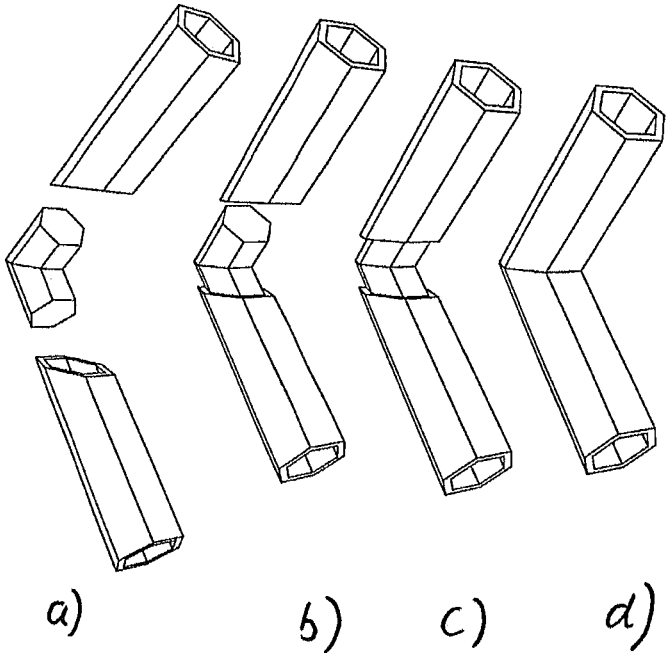

In this regard, the internally hollow bodies 10 can be shaped more or less in any desired manner to produce the connection between two bar elements 1, 1', in other words as an angled element or as a curved element, for example, so that angular or curved connections between multiple bar elements 1, 1' according to the representation in FIG. 8 are also conceivable. In this regard, curved connections can be implemented only when using special connection elements, in any case elements not produced from bamboo, for example produced by die-casting or 3D printing. In detail, FIG. 8 shows the different connection stages between two bar elements 1, 1' that participate in the connection, in a perspective representation, in each instance, which elements can be connected with one another by means of an internally hollow body 10 according to the exploded representation or in the representation before the formation of the connection according to FIG. 8 *a*), which body is formed, in this case, as an angled element, with the formation of a right angle.

In this regard, the internally hollow body 10 is introduced into the bar element 1, at least in certain sections, according to the representation in FIG. 8 *b*), before the other bar element 1' is then also set onto the internally hollow body 10, at least in part, according to FIG. 8 *c*), and finally a closed connection between the two bar elements 1, 1' is produced by means of completely setting on the two bar elements 1, 1' that participate in the connection, in such a manner that ultimately, an angled element is produced by means of the configuration of the connection.

Figure 9:
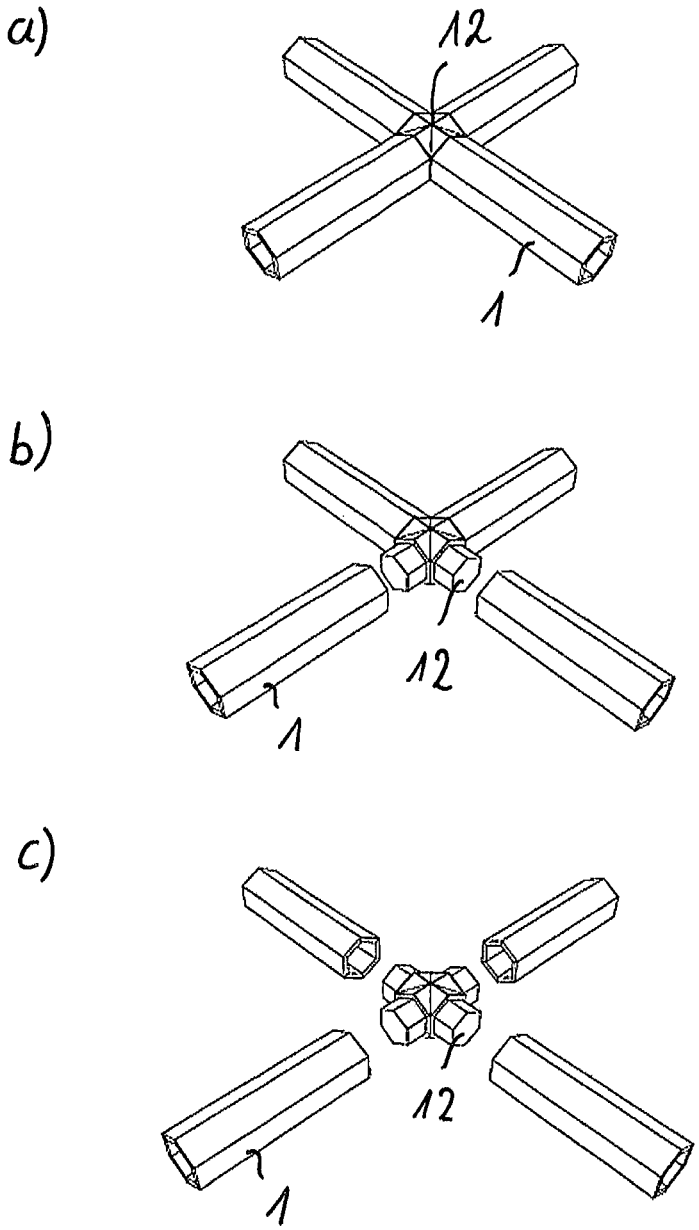

Any desired other constructions can also be produced by means of the selection of suitable connection elements. Thus, FIG. 9 shows the individual steps of the formation of a cross-connection, in that in detail, four bar elements 1 are connected, using a central cross-connector 12, in that the bar elements 1 are set onto the individual connection pieces of the cross-connector 12, in each instance.

More or less any desired lattice works, grid constructions, frameworks, three-dimensional bodies or, in the case of connection elements having integrated articulations, also spatially changeable bodies or articulated connections can be produced by means of these and comparable constructions.

In connection with the formation of more complex constructions, expansive constructions such as frameworks or three-dimensional bodies, it has proven itself if the individual connection elements are provided with cuffs for face-side accommodation of the bar elements 1 according to the invention, so that these are stabilized in their end region, and possible breakout of the bar element 1 in the end region is prevented or the connection is only insignificantly impaired by it. Such connections have proven to be strong also in connection with simple constructions.

Figure 10:
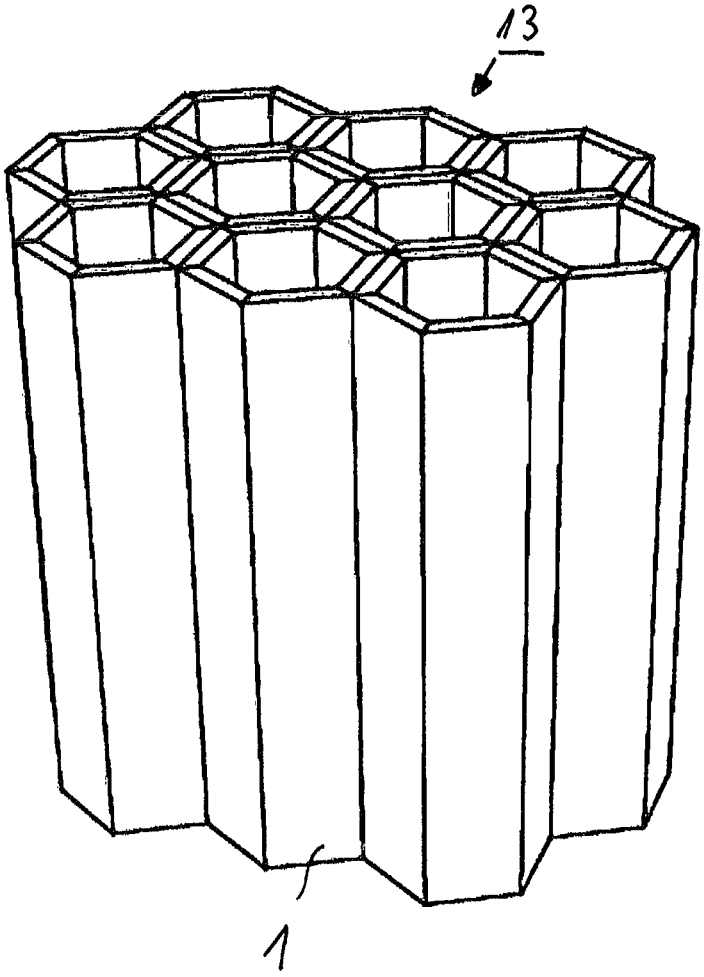
FIG. 10: a honeycomb structure composed of bar elements connected with one another, in a perspective view.

Furthermore, wall structures of any desired shape and wall thickness can be produced using the bar elements 1, 1' according to the invention, which can be joined together by means of suitable adhesive connections, to produce a composite arrangement or honeycomb arrangement 13 according to FIG. 10. In this regard, the individual bar elements 1, 1' for forming the wall structure, can once again be provided with reinforcements, if necessary, as explained above, or can be filled with reinforcement material or with insulation material, if necessary.

Figure 11:
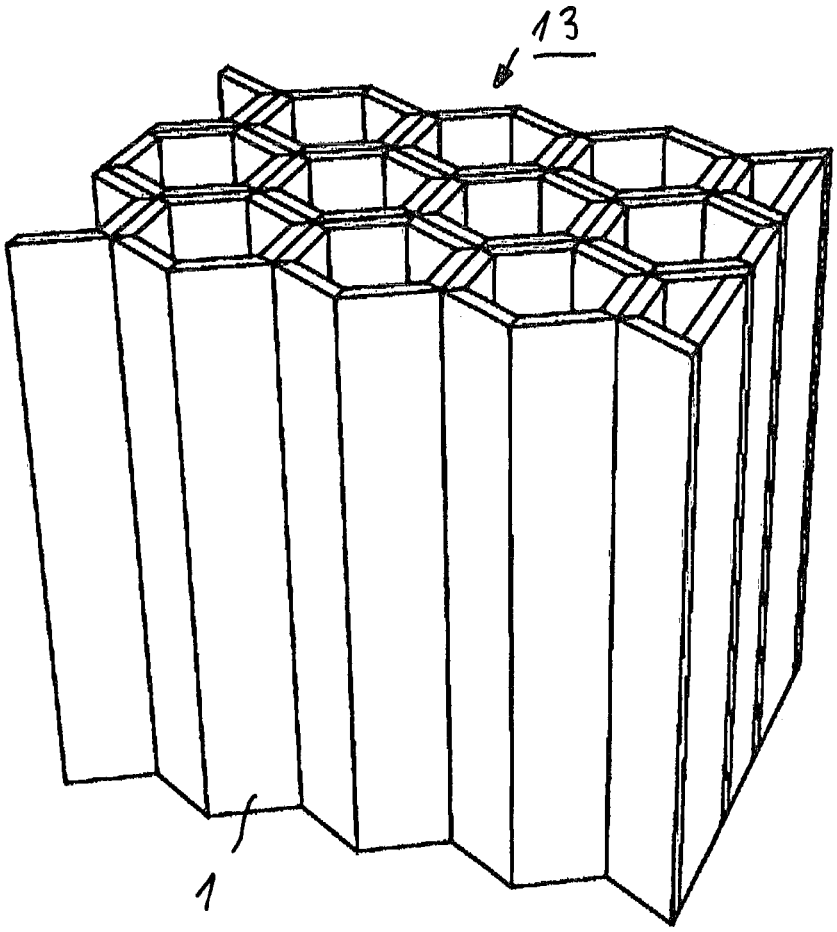
FIG. 11: a honeycomb structure composed of bar elements connected with one another, in a deviating embodiment, in a perspective view.

In this regard, fundamentally closed bar elements 1, 1' do not necessarily have to be inserted into the honeycomb structure 13 according to the representation in FIG. 11. Instead, alternatively, open bar elements 14 or closed half-bars 15 can also be integrated, for example in order to be able to produce a defined wall end.

The honeycomb arrangements 13 shown in FIGS. 10 and 11 are usually advantageously provided with planking on one or both sides, particularly in the construction sector, or produced using sandwich construction right from the start, with interposition of the honeycomb arrangement. In this regard, this sandwich construction can already take place with the interposition of insulating materials or insulation materials, if applicable leaving out any channels required for installation.

REFERENCE SYMBOL LIST

1, 1' bar element
2 strip
3, 3' longitudinal edge
4 round inner cross-section
5 round outer cross-section
6 further bamboo strip
7 inner tube
8 outer mantle
10 internally hollow body
11 excess length
12 cross-connector
13 honeycomb arrangement
14 open bar element.
15 half-bar

The invention claimed is:

1. A method for producing a bar element for use as a construction element, the method comprising:

(a) forming an at least partially hollow element comprising a plurality of strips and having an inner wall forming an interior; and either (b) coating the inner wall with at least one of a plastic or a resin to form a coated interior and moving a piston having a round outer cross-section through the coated interior; or (c) introducing into the interior an inner tube coated with a parting agent and an outer mantle comprising at least one of a plastic or a resin coated on the parting agent and removing the inner tube from the interior after hardening of the plastic or resin coated on the outer mantle, whereby the bar element is produced with an inner cross-section having defined dimensions in the form of a fillet.

2. The method according to claim 1, wherein glass fibers or carbon fibers are worked into the outer mantle in a longitudinal or transverse direction or a woven lattice structure of glass fibers or carbon fibers is wrapped around the outer mantle prior to performing step (c) and subsequently, upon performing step (c), the bar element becomes reinforced with the glass fibers or carbon fibers in the longitudinal or transverse direction or with the woven lattice structure.

3. The method according to claim 1, wherein each strip of the plurality of strips has a trapezoid cross-section.

4. The method according to claim 3, wherein the plurality of strips comprises six strips and the hollow element is formed by connecting, by an adhesive, longitudinal edges of the six strips, and wherein the bar element has a hexagonal cross-section.

5. The method according to claim 4, wherein the longitudinal edges are configured to be planar.

6. The method according to claim 3, wherein the plurality of strips comprises eight strips and the hollow element is formed by connecting, by an adhesive, longitudinal edges of the eight strips, and wherein the bar element has an octagonal cross-section.

7. The method according to claim 1, wherein the inner tube has a round, triangular, or square shape in at least some sections and, in step (c), impresses an inner contour into the bar element corresponding to the round, triangular, or square shape.

8. The method according to claim 7, wherein multiple bar elements are joined together by means of at least one internally hollow body provided with at least one connector piece to produce polygonal constructions, grid constructions, three-dimensional bodies, geometric bodies, or lattice works.

9. The method according to claim 1, further comprising, subsequent to step (b) or step (c), inserting an internally hollow body into the interior of the bar element.

10. The method according to claim 9, wherein the internally hollow body projects beyond a face side of the bar element, wherein another, subsequent bar element is set onto and/or otherwise connected with the internally hollow body with force fit and/or shape fit, and wherein at least an end section of the internally hollow body functions as a connector piece for the subsequent bar element.

11. The method according to claim 9, wherein the internally hollow body has an angled-away or cropped passage.

12. The method according to claim 9, wherein the internally hollow body has at least one articulated connection in a connection region of the internally hollow body between the bar element and a subsequent bar element connected to the bar element.

13. The method according to claim 9, wherein a separate connection element, comprising at least two cuff sections that are spaced apart from one another, is set onto the internally hollow body in such a manner that a face-side end section of the internally hollow body is held with shape fit in one of the cuff sections.

14. The method according to claim 13, wherein the internally hollow body, connection element, and/or cuff sections are produced using a 3D printing method or are die-cast.

15. The method according to claim 1, wherein the at least partially hollow element comprising a plurality of strips is half-open, resulting in a half-open bar element.

16. The method according to claim 1, wherein multiple bar elements are connected with one another along outer contours of the bar elements to form a composite bar arrangement.

17. The method of claim 16, wherein the multiple bar elements comprise open or closed bar elements and/or closed half-bar elements.

18. The method according to claim 16, wherein the composite bar arrangement has planks on one or both sides and/or is provided with an outer planking on both sides with insulating material and/or reinforcement materials interposed between the composite bar arrangement and the planking.

* * * * *